United States Patent [19]

Fotheringham et al.

[11] 4,300,130

[45] Nov. 10, 1981

[54] ANTI-THEFT ALARM CIRCUIT AND COMPATIBLE WARNING PLUGS

[76] Inventors: Robert K. Fotheringham, 3863 Steilacoom Blvd. S.W.; Glen E. Spieth, 5928 Steilacoom Blvd. S.W., both of Tacoma, Wash. 98499

[21] Appl. No.: 89,193

[22] Filed: Oct. 29, 1979

[51] Int. Cl.[3] ..... G08B 13/02

[52] U.S. Cl. ..... 340/568; 340/571; 340/687

[58] Field of Search ..... 340/531, 538, 548, 568, 340/571, 687

[56] References Cited

U.S. PATENT DOCUMENTS

| | | | |
|---|---|---|---|
| 3,484,775 | 12/1969 | Cline | 340/687 |
| 3,794,989 | 2/1974 | Manley et al. | 340/687 |
| 4,075,617 | 2/1978 | Wireman | 340/687 |
| 4,097,843 | 6/1978 | Basile | 340/687 |
| 4,151,521 | 4/1979 | Wirth, Jr. | 340/568 |

*Primary Examiner*—Alvin H. Waring

*Attorney, Agent, or Firm*—Kenneth S. Kessler

[57] ABSTRACT

An anti-theft alarm circuit and compatible warning plugs; the warning plugs are designed to look to be an integral part of the stereo component or appliance to which they are attached. When the warning plugs are disconnected, however, the alarm system is activated.

5 Claims, 6 Drawing Figures

ANTI-THEFT ALARM CIRCUIT AND COMPATIBLE WARNING PLUGS

BACKGROUND OF THE INVENTION

A number of United States patents have directed themselves to the prevention of anti-theft and shoplifting alarm devices.

The United States patents by Weathers, U.S. Pat. No. 4,121,201; Marshall U.S. Pat. No. 3,972,039; and W. D. Cline U.S. Pat. No. 3,484,755 are directed to fairly complex systems used in department stores and motels.

The present invention is directed primarily towards residential use and admittedly is not directed to the protection of extremely valuable articles against sophisticated felons.

However, the system and the attendant warning plugs and jacks are designed to look to be an integral part of the stereo component or appliance and, thus, camouflage their function. When the potential thief comes to take, for instance, a stereo, he will naturally disconnect the wires from the stereo and since the warning plugs and jacks are designed to look to be serving a useful purpose with the stereo, the thief will also disconnect the warning plugs.

Upon disconnection, the warning plugs form a closed circuit and thus activate a warning alarm.

SUMMARY OF THE INVENTION

Direct current power is introduced to a warning plug. The warning plug is connected to a stereo or appliance which the owner wishes to protect. If a thief should attempt to disconnect the warning plug, the warning plug is designed such that it will form a closed circuit which in turn activates a relay.

When the relay is energized, the relay in turn closes a switch which allows the DC current which is also applied to the warning plug, to activate a warning alarm.

The warning plugs are designed to camouflage their function as warning plugs, and look to the potential thief, as serving the useful function and connection with the stereo or appliance.

DETAILED DESCRIPTION OF THE DRAWINGS

A series of warning plugs and warning jacks are disclosed. The warning plugs and jacks are designed to look to be an integral part of the stereo component or appliance and not a separate warning device. By camouflaging the function of the warning plugs and jacks, the warning system is protected from being neutralized except by the most sophisticated of felons.

Figure 1:
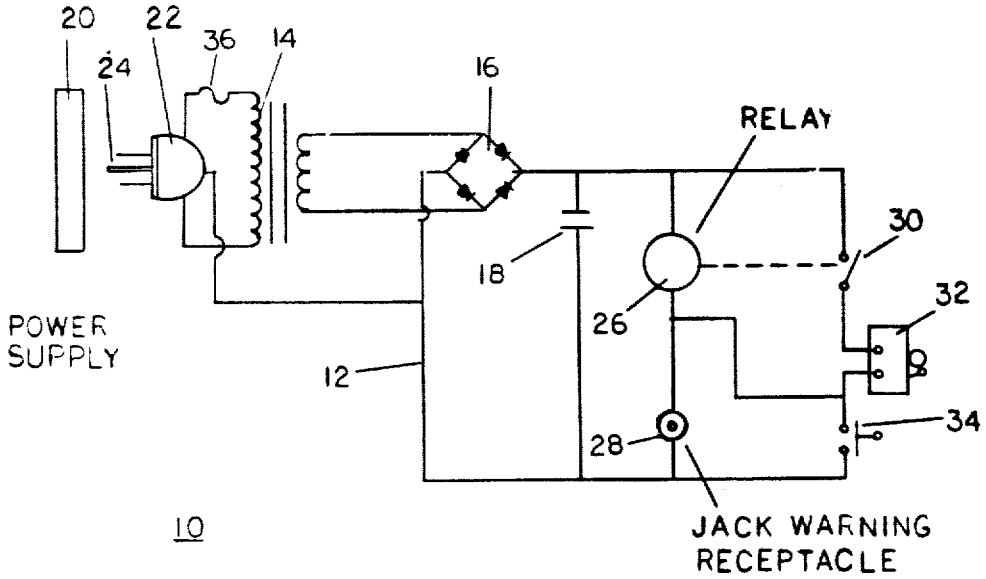
FIG. 1 is an electrical circuit diagram illustrating a preferred embodiment for the warning signal.

In FIG. 1 an electrical circuit diagram 12 of the anti-theft alarm 10 is illustrated. A number of electrical circuits would work in connection with the warning sensors. In the preferred embodiment, transformer 14 converts 120 volt AC to 10 to 15 volts AC to bridge rectifier 16. Bridge rectifier 16 in turn provides a 12 to 18 volt DC potential across capacitor 18. Capacitor 18 acts as the filter for the power supply 20. Also, the ground of the capacitor 18 is connected to the plug ground 24 of the AC plug 22.

Connected to the power supply 20 and in parallel with the capacitor 18 is relay 26. In series with the relay 26 is warning receptacle 28. When the receptacle 28 interrupts the circuit the relay 26 remains de-energized.

In the preferred embodiment of FIG. 1, the warning receptacle 28 is normally open and interrupting the circuit. However, when the alarm sensor is connected to the warning receptacle 28 and the contacts at the sensor end short because of disconnection from the stereo component or appliance, the circuit is completed thus energizing the relay 26.

When the relay 26 is energized, the relay closes switch 30. With switch 30 closed, the warning horn 32 is activated. The warning horn 32 may be positioned wherever most advantageous and may be physically separated from the remainder of the alarm. Any number of warning devices may be substituted for a warning horn 32.

In series with the warning horn 32 is interrupter switch 34. The interrupter switch is capable of de-energizing the warning horn 32 and resetting relay 26 to its normally de-energized condition. The anti-theft alarm electronic circuit 12 is designed to remain active until it is shut-off by the interrupter switch 34 or the power is disengaged. The interrupter switch 34 may be placed in a remote or camouflaged position that only an owner will be able to locate.

In the preferred embodiment a fuse 36 provides fuse protection for the circuit 12.

Figure 2:
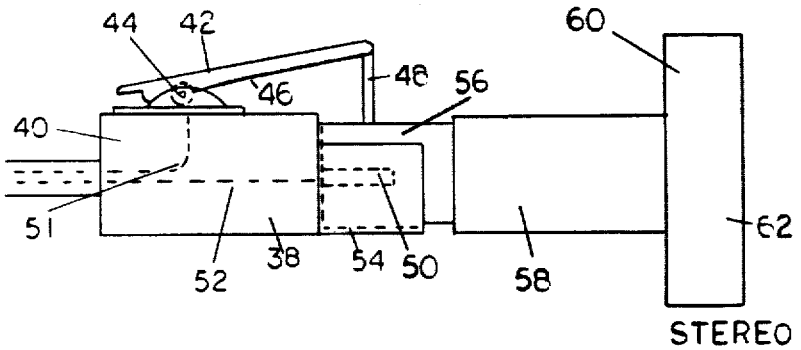
FIG. 2 is a perspective view of a warning plug which is attached to a typical jack mounted in the back of a stereo.
Figure 3:
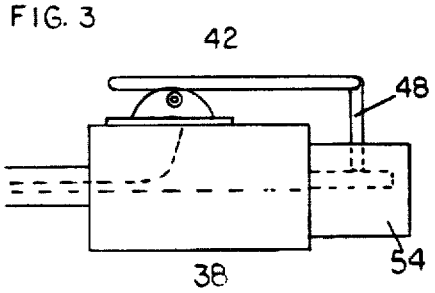
FIG. 3 is a perspective view of the warning plug of FIG. 2 wherein the plug has been disconnected from the jack.

In FIG. 2, a side view of the warning plug 38 is illustrated connected to a female receptacle 58 of a stereo component. The warning plug 38 is designed to fit in as one of the integral connections of the stereo component. Thus, only the most sophisticated of felons would be able to detect the location of the warning plug. The placement of the warning plug 38 is nearly totally effective when it is considered that sophisticated felons are seldom found to be stealing property such as stereos.

Affixed to the cylindrical housing 40 of the warning plug 38 is rotatable prong connector 42. The rotatable prong connector 42 rotates about rod 44 by means of spring 46. At the forward end of the rotable prong connector 42 is prong 48. The prong 48 is biased to rotate towards the outer connector 50. Thus, when there is nothing to impede its progress, the prong 48 will rotate into connection with the center connector 50.

Secured approximately at the center of the cylindrical housing 40 is the center connector 50. The center connector does not extend past the forward edge of cylindrical housing 40. The center connector wire 52 is affixed to the center connector 50. Affixed to the rotatable prong connector 42 is wire 51. Wire 51 energizes the rotatable prong connector 42. The center connector wire 52 connects the center connector 50 with the relay 26.

Also extending from the cylindrical housing 40 and surrounding the center connector 50 is the center connector cylindrical housing 54. The center connector cylindrical housing 54 is designed to surround the center connector except for gap 56. Gap 56 is constructed of sufficient width to allow for the passage of the prong 48 through the gap 56 to come into contact with the center connector 50. The center connector cylindrical housing 54 is designed to receive the female receptacle 58 of the stereo terminal 60.

When the center connector cylindrical housing 54 receives the female receptacle 58 the center connector does not extend into the female receptacle 58. Also, when the female receptacle 58 is fitted within the center connector cylindrical housing 54 it can be seen that the prong 48 rests on the outer circumference of the female receptacle 58 and is prevented from rotating into connection with the center connector 50. Thus, with the prong separated from the center connector 50 the circuit is interrupted and no warning signal is experienced. Thus, it can be seen that when the warning plug 38 is secured to the stereo terminal 60 there is no warning signal, and the warning plug 38 is in effect camouflaged for the warning plug 38 in effect looks like a useful plug in the stereo system 62.

When the potential thief is in the process of stealing the stereo 62, for instance, he inevitably will activate the alarm for he must disengage the warning plug 38 in order to take the stereo 62 out of the room. The thief would not be able to leave the room without disengaging the jacks, for without disengaging the jacks all the wires would still be secured to the stereo.

Figure 4:
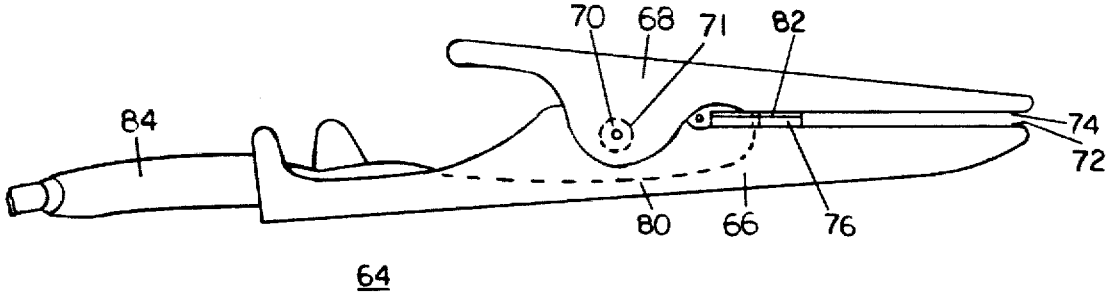
FIG. 4 is a perspective view of an alligator warning clip to be used in conjunction with stereo gear or appliances.

As set forth previously, a number of configurations of warning plugs 28 may be utilized in the anti-theft alarm system 10. As set forth in FIG. 4, alligator warning clip 64 is capable of integrating effectively into the anti-theft alarm system 10.

The alligator warning clip 64 includes two jaws: a foundation jaw 66 and a rotatable jaw 68. The rotatable jaw 68 is hinged to the foundation jaw 66 by clip hinge 70. Spring 71 is secured within the alligator warning clip 64 and biases the rotatable jaw 68 towards the foundation jaw 66 such that when the leading edges 72 and 74 of the foundation jaw 66 and rotatable jaw 68 are placed over either a plug of a stereo or some other extension of an appliance, the leading edges 72 and 74 hold the alligator warning clip 64 secure. The leading edges 72 and 74 have no teeth and the clamping pressure is such that when the stereo or appliance is moved from its existing position, the alligator warning clip 64 is capable of sliding off from whatever it is hooked to.

Affixed to the foundation jaw 66 is circuit board 76. The circuit board 76 in the preferred embodiment is a printed circuit board with conductive material on a mating surface 82. The circuit board 76 has a small hole 78 through which the center conductor 80 of shielded coax wire is placed through and is secured to the mating surface 82 of the circuit board 76. The shield of the coax wire 84 is secured to the foundation jaw 66 at a solder point to prevent movement of the coax shield 84. The circuit board 76 is bonded to the foundation jaw 66 at a point where the mating surface 82 is bonded to the foundation jaw 66. The mating surface 82 is further placed on the upper surface of the circuit board 76 in order to receive the rotatable jaw 68 when the rotatable jaw 68 is placed in a closed position. Thus, when the rotatable jaw 68 is in an open position, there is no circuit formed, for there is an interrupter between the wire 80 and coax shield 84. However, when the spring tension is released and the rotatable jaw 68 comes down on the top of the circuit board 76 a circuit is completed for the rotatable jaw is electrically conductive. Thus, when the clip is in its normally open position, there is an open circuit. However, when it is removed from an appliance, the jaws will close and complete the circuit that triggers the anti-theft alarm 10.

Figure 5:
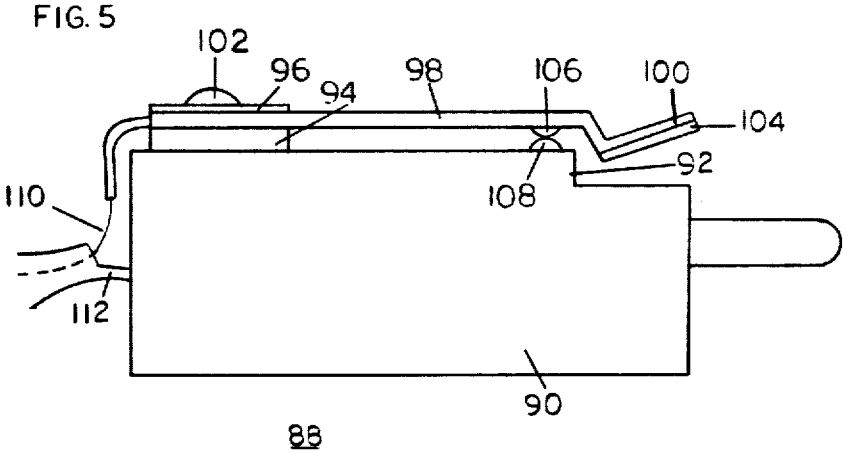
FIG. 5 is a perspective view of a modified warning plug.
Figure 6:
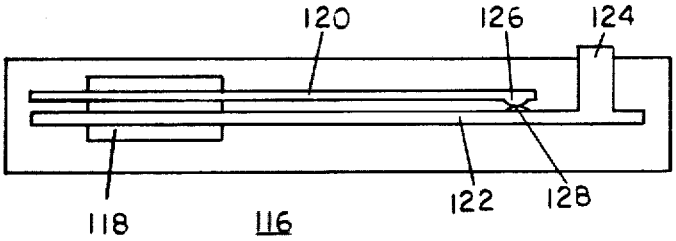
FIG. 6 is a perspective view of a pressure sensitive switch.

A further configuration of the warning plug 28 is set forth in FIG. 5. The warning plug 88 is designed to interface with the typical "RCA" plug on a stereo or similar piece of equipment. A warning plug 88 has a surrounding cylinder 90. The forward edge of the surrounding cylinder 90 has an indention 92. Affixed to the surrounding cylinder 90 are two fiberboard insulators 94 and 96 which have between them electrically conductive clip 98. The electrical conductive clip 98 has at its far end a jog extension 100 which extends into the indention 92. The fiberboard insulators are held secured in place to the surrounding cylinder 90 by pop rivet 102. At the interface of the jog extension 100 is secured an insulating pad 104. Thus, when the warning plug 88 is positioned within the female plug 58, the outer surface of the female plug 58 comes into contact with the insulating pad 104 and forces the electrical conductive clip to rise off of the surrounding cylinder 90. Secured to both the surrounding cylinder 90 and the electrical conductive clip 98 are conduction points 106 and 108 secured to the electrical conductive clip and surrounding cylinder respectively. Thus, when the warning plug 88 is positioned within the female plug 58 the electrical conductive clip 98 is forced away and, thus, the conductive points 106 and 108 are not in contact. However, when the warning plug 88 is disengaged from the female plug 58 the electrical conductive clip 98 springs forward thus causing a connection between the conductive points 106 and 108.

The center conductor of the coax wire 110 is connected to terminal 114 and the shield of the coax wire 112 is connected to the surrounding cylinder 90.

The warning plug 88 is wired such that the surrounding cylinder is a conductor of electricity. Thus, when the warning plug is disengaged from the female plug 58, the conductive points 106 and 108, come into contact, an electrical connection is achieved with the electrical conductive clip and similarly with terminal 114 which completes the anti-theft alarm electronic circuit 12 and, thus, activates the alarm 10.

As a final example of a configuration for a warning plug 28, is pressure switch 116. The pressure switch 116 has a base 118 from which extends electrically conductive extension rod 120. Parallel to electrically conductive rod 120 is bendable electrically conductive rod 122. Attached to the far extremity of the bendable electrical conductive rod 122 is pressure point 124. Affixed to the electrically conductive rods 120 and 122 are conductive points 126 and 128. The conductive points 126 and 128 oppositely face each other and are designed such that when no pressure is applied to pressure point 124, they will touch and thus form a path for electrical current.

Thus, the pressure point 124 may be mounted behind a tapedeck, for instance, between the tapedeck and a wall. If the tapedeck is removed, for instance, pressure is removed from the pressure point 124 and thus the bendable electrical rod 122 which is biased in the direction of electrically conductive rod 120 automatically springs toward the electrically conductive rod 120 and thus conductive points 126 and 128 make contact and form a path for electrical current.

The pressure switch is also effective when mounted over, under or behind any object that must be protected.

It should also be pointed out that the circuit can encompass a number of variations including a window switch, a door switch, pull trap switch, or as an example a modified smoke alarm which could trigger this device. With the addition of one relay to the circuitry, window tape or any other normally closed switching can be utilized to trigger the alarm. Thus, the system set forth herein can be adapted for use in any number of circumstances.

Although a particular preferred embodiment of the invention has been disclosed above for illustrative purposes it will be understood that variations or modifications thereof which lie within the scope of the appended claims are contemplated.

I claim:

1. A warning plug for use in connection with an alarm system for indicating the disconnection of a stereo or appliance from the warning plug comprising:

an electrically conductive housing;

a center connector positioned and secured within the housing;

an electrically conductive rotatable prong secured to the housing, the rotatable prong biased such that when there is nothing in the path of the rotatable prong the rotatable prong will come into contact with the center connector;

a wire connected to the center connector;

a wire connected to the electrically conductive housing; and a means of connecting the warning plug to the appliance or stereo such that when the warning plug is connected the rotatable prong is prevented from connection with the center conductor.

2. The warning plug of claim 1 wherein the means for connecting the warning plug to the appliance or stereo comprises:

a surrounding cylinder capable of interfacing with a female receptacle with a gap, the surrounding cylinder affixed forward of the conductive housing and surrounding the center connector in a position such that the gap is in alignment with the rotatable prong allowing the rotatable prong to come into connection with the center connector.

3. A warning plug for use in connection with an alarm system for indicating the disconnection of a stereo or appliance from the warning plug comprising:

an electrically conductive housing with an indention at its forward end;

a conductivve point affixed to the outer surface of the electrically conductive housing;

an electrically conductive clip affixed to the outer surface of the conductive housing, the clip being biased towards the conductive housing;

a conductive point affixed to the electrically conductive clip such that when the clip is biased towards the conductive housing the two conductive points come into contact;

a jog extension secured to the forward edge of the clip such that the jog extension extends into the indention when in a closed position, and when the electrically conductive housing is interfaced with a receptacle the jog extension, clip and conductive point are lifted from contact with the conductive housing;

a wire affixed to the electrically conductive clip; and a wire affixed to the electrically conductive housing.

4. An alarm system for indicating the disconnection of a stereo or appliance from a warning plug comprising:

a means for supplying DC power to the warning plug;

a relay in series with the warning plug such that when the warning plug is disconnected the relay is energized;

a switch controlled by the relay;

an alarm in series with the relay controlled switch such that when the switch is in the closed position the alarm is activated;

an electrically conductive housing;

a center connector positioned and secured within the housing;

an electrically conductive rotatable prong secured to the housing, the rotatable prong biased such that when there is nothing in the path of the rotatable prong the rotatable prong will come into contact with the center connector;

a wire connected to the center connector;

a wire connected to the electrically conductive housing; and a means of connecting the warning plug to the appliance or stereo such that when the warning plug is connected the rotatable prong is prevented from connection with the center conductor.

5. An alarm system for indicating the disconnection of a stereo or appliance from a warning plug comprising:

a means for supplying DC power to the warning plug;

a relay in series with the warning plug such that when the warning plug is disconnected the relay is energized;

a switch controlled by the relay;

an alarm in series with the relay controlled switch such that when the switch is in the closed position the alarm is activated;

an electrically conductive housing with an indention at its forward end;

a conductive point affixed to the outer surface of the electrically conductive housing;

an electrically conductive clip affixed to the outer surface of the conductive housing, the clip being biased towards the conductive housing;

a conductive point affixed to the electrically conductive clip such that when the clip is biased towards the conductive housing the two conductive points come into contact;

a jog extension secured to the forward edge of the clip such that the jog extension extends into the indention when in a closed position, and when the electrically conductive housing is interfaced with the receptacle the jog extension, clip and conductive point are lifted from contact with the conductive housing;

a wire affixed to the electrically conductive clip; and a wire affixed to the electrically conductive housing.

* * * * *